US009909250B1

(12) United States Patent
Greenspon et al.

(10) Patent No.: US 9,909,250 B1
(45) Date of Patent: Mar. 6, 2018

(54) APPARATUS FOR HANGING CLOTHES

(71) Applicant: Honey-Can-Do International, LLC, Berkeley, IL (US)

(72) Inventors: Steven B. Greenspon, Berkeley, IL (US); Valerie A. Snow, Berkeley, IL (US); Pamela S. Mical, Berkeley, IL (US); Slobodan S. Zivanovic, Berkeley, IL (US)

(73) Assignee: Honey-Can-Do International, LLC, Berkeley, IL (US)

( * ) Notice: Subject to any disclaimer, the term of this patent is extended or adjusted under 35 U.S.C. 154(b) by 0 days.

(21) Appl. No.: 15/435,411

(22) Filed: Feb. 17, 2017

Related U.S. Application Data

(63) Continuation-in-part of application No. 29/589,087, filed on Dec. 28, 2016.

(51) Int. Cl.

| | |
|---|---|
| ***A47F 7/00*** | (2006.01) |
| ***A47G 29/00*** | (2006.01) |
| ***A47B 43/00*** | (2006.01) |
| ***A47B 47/00*** | (2006.01) |
| ***A47B 57/00*** | (2006.01) |
| ***D06F 57/08*** | (2006.01) |
| ***A47F 5/10*** | (2006.01) |
| ***A47G 25/06*** | (2006.01) |
| ***A47F 5/04*** | (2006.01) |
| ***D06F 57/04*** | (2006.01) |

(52) U.S. Cl.

CPC ..... *D06F 57/08* (2013.01); *A47B 43/00* (2013.01); *A47F 5/04* (2013.01); *A47F 5/10* (2013.01); *A47G 25/0664* (2013.01); *D06F 57/04* (2013.01)

(58) Field of Classification Search

CPC ..... D06F 57/08; D06F 57/04; D06F 57/12; A47F 5/06; A47F 5/08; A47F 3/08; A47F 5/04; A47F 5/10; A47G 25/0664; A47G 25/0685; A47G 25/0671; A47B 43/00; A47B 45/00; F26B 25/18; F26B 9/003; A61L 9/20

USPC ..... 211/85.3, 196, 197, 205, 203, 175, 172, 211/85.24; 248/168, 166, 163.1, 431; D32/55, 276, 3, 58; D6/510, 525; D7/354, 629, 368

See application file for complete search history.

(56) References Cited

U.S. PATENT DOCUMENTS

| | | | | | |
|---|---|---|---|---|---|
| 131,696 | A * | 9/1872 | Mathewson | ..... | A47F 5/02 135/147 |
| 140,193 | A * | 6/1873 | Graves | ..... | D06F 57/04 211/167 |
| 146,307 | A * | 1/1874 | Bogart | ..... | D06F 57/04 211/167 |
| 179,610 | A * | 7/1876 | Robinson | ..... | D06F 57/04 211/171 |
| 353,332 | A * | 11/1886 | Tremble | ..... | D06F 57/04 211/171 |

(Continued)

*Primary Examiner* — Jennifer E. Novosad
(74) *Attorney, Agent, or Firm* — Adam K. Sacharoff; Much Shelist, P.C.

(57) ABSTRACT

A clothes rack having a lower subassembly, a center subassembly and an upper subassembly. The lower subassembly is configured with a tripod base for support on a surface. The center and upper subassemblies having arms that pivotally expand to form extension arms that are each configured to hold hangers or articles of clothing.

9 Claims, 8 Drawing Sheets

(56) References Cited

U.S. PATENT DOCUMENTS 438,517 A * 10/1890 Adams ..... A47F 5/02 211/163
723,114 A * 3/1903 Witt ..... A47F 5/04 211/205
843,712 A * 2/1907 Straub ..... D06F 57/04 211/197
906,963 A * 12/1908 Thompson ..... D06F 57/04 211/165
1,274,849 A * 8/1918 Bullerdick ..... A01F 25/12 211/125
1,344,660 A * 6/1920 Stevenson ..... D06F 57/12 211/171
1,400,359 A * 12/1921 Hagerman ..... D06F 57/04 211/165
1,525,701 A * 2/1925 Rose ..... A47G 25/0664 211/196
1,713,673 A * 5/1929 Nelson ..... D06F 57/04 248/170
1,951,979 A * 3/1934 Hoffmire ..... D06F 57/04 211/100
2,708,324 A * 5/1955 Murdock ..... A47G 33/06 211/1
3,626,602 A * 12/1971 Glowacki ..... D06F 57/04 34/232
4,895,261 A * 1/1990 Yacobian ..... A47F 5/04 211/167
5,458,249 A * 10/1995 Shang-Lu ..... D06F 57/04 211/196
5,819,961 A * 10/1998 Harris ..... A47G 25/0671 211/196
D466,719 S * 12/2002 Fitzpatrick ..... D6/681.3
6,702,129 B1 * 3/2004 Harris ..... A47G 25/0664 211/172
7,077,276 B1 * 7/2006 Romano ..... D06F 57/04 211/118
7,165,689 B2 * 1/2007 McDaniel ..... A47B 96/061 211/116
7,530,543 B1 * 5/2009 Kremzar ..... A47B 94/02 160/24
D643,648 S * 8/2011 Eason ..... D6/682
D665,190 S * 8/2012 Fitzpatrick ..... D6/681.3
8,418,860 B2 * 4/2013 Rimmer ..... D06F 57/04 211/196
9,518,696 B1 * 12/2016 Lin ..... F16M 11/38
2003/0164348 A1 * 9/2003 Seng ..... D06F 57/04 211/196

* cited by examiner

APPARATUS FOR HANGING CLOTHES

FIELD OF THE INVENTION

The present invention relates to a hanging clothes rack and, more particularly, to a tripod base collapsible clothes rack.

DISCUSSION OF THE RELATED ART

Clothes racks are well known and used extensively for drying or hanging laundry and other type of items. One main issue is when the user has a lot of clothes that need to be hung on hangers the ability to lay a lot of clothes out for drying, ironing, or hanging purposes is difficult. It is desirable to provide such a rack that is capable of collapsing for storage purposes but which can expand to provide for a plurality of hanging options to the user.

SUMMARY OF THE INVENTION

The present invention is directed to a clothes rack used for hanging clothes. The clothes rack includes a tripod leg base and two different tripod arm sections to provide a plurality of hanging options to the user.

BRIEF DESCRIPTION OF THE DRAWINGS

For a fuller understanding of the nature of the present invention, reference should be made to the following detailed description taken in conjunction with the accompanying drawings in which.

DETAILED DESCRIPTION OF THE PREFERRED EMBODIMENTS

Figure 1:
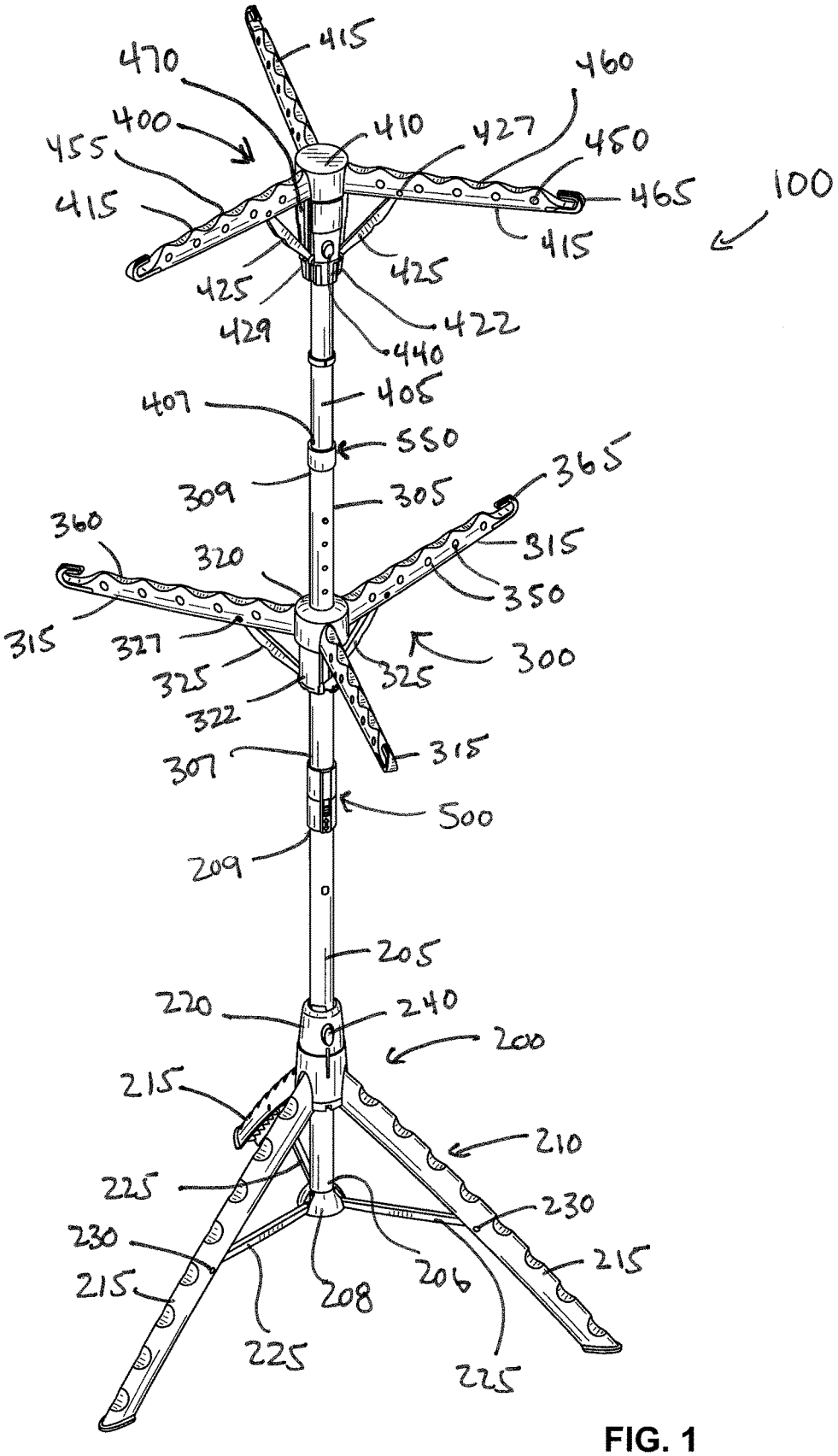
FIG. 1 is a perspective view of the clothes rack illustrated in a fully expandable position.
Figure 2:
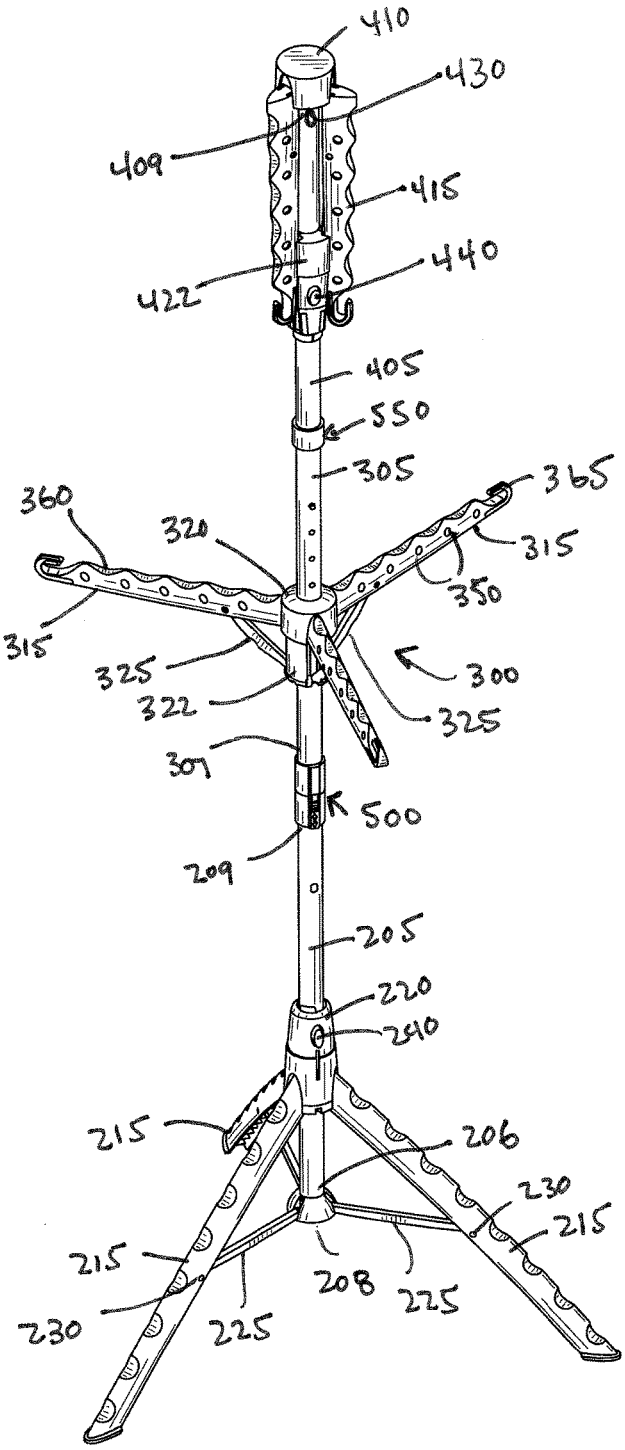
FIG. 2 is a perspective view of the clothes rack from FIG. 1 illustrated with the top tripod arm section in a collapsed position.
Figure 3:
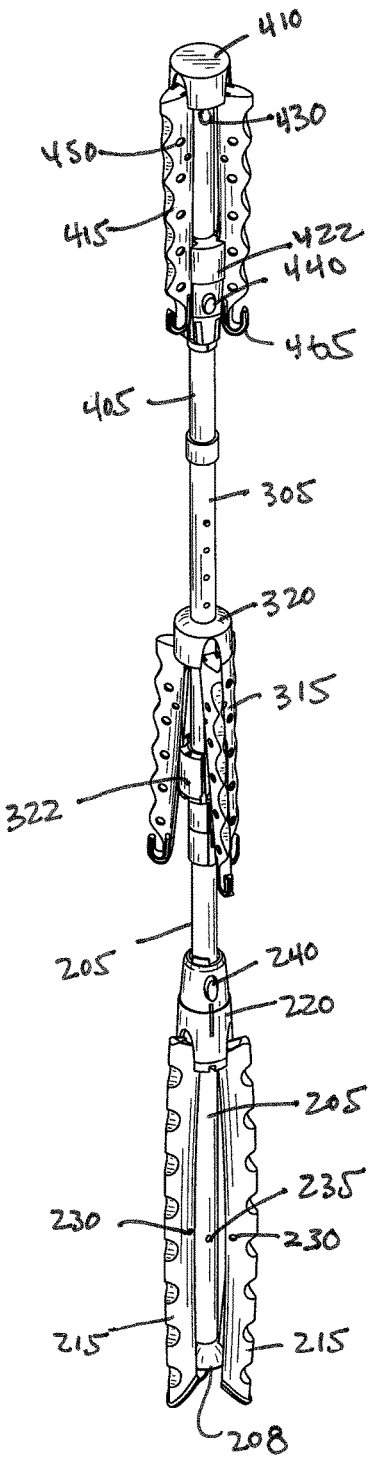
FIG. 3 is a perspective view of the clothes rack from FIG. 1 illustrated in a fully collapsed position.

Referring to the several views of the drawings, the present invention is a clothes rack 100, which includes three subassembly sections that are configured to be separated from each other into a lower subassembly 200, a center subassembly 300, and an upper subassembly 400.

The lower subassembly 200 includes a lower vertical shaft 205, which has an bottom end 206 that is connected to a base cap 208. The lower subassembly 200 further includes a tripod base 210 formed by three legs 215 pivotally connected on the upper edges to a hub 220, which is slidably received by the lower vertical shaft 205. Three rods 225 are separately and pivotally secured at one end to the base cap 208 and pivotally secured at the other end to a mid-point 230 on each of the three legs 215. The lower subassembly 200 may further include an aperture 235 on the lower vertical shaft 205 defined to receive a latch 240 defined on the hub 220 to secure the tripod base 210 in an expanded position. Retracting the latch 240 releases the hub 220, such that the hub 220 can slide along the lower vertical shaft to collapse the tripod 210. The tripod base 210 on the lower subassembly 200 is therefore respectively expanded for use or collapsed for storage.

The center subassembly 300 includes a center vertical shaft 305, which has a lower end 307 and an upper end 309. The lower end 307 of the center vertical shaft 305 secures to an upper end 209 of the lower vertical shaft 205 via a center coupling 500 (further defined below).

The center subassembly 300 includes a plurality of center arms 315 that are pivotally secured at one end to an upper center hub 320. The upper center hub 320 is secured in position to the center vertical shaft 305. Each center arm 315 further has a center rod 325 that is pivotally secured at one end to a position 327 along the center arm 325 and the center rod 325 has another end 329 pivotally secured to a lower center hub 322 that is slidably received by the center vertical shaft 305 and which is vertically movable in relation to the upper center hub 320. The upper center hub 320 further includes an tab 330 configured to receive a latch 340 defined on the lower center hub 322. When the center arms 315 are expanded outwardly the lower center hub 322 slides towards the upper center hub 320 and when fully expanded, the latch 340 locks onto the tab 330 locking the center arms 315 in position. Retracting the latch 340 releases the tab 330, such that the lower center hub 322 can slide along the center vertical shaft 305 to collapse the center arms inwardly. When the center arms 315 are fully expanded the center rods 325 provide support especially when clothes are placed on the expanded center arms 315. The center arms 315 are collapsible for storage purposes.

Each of the center arms 315 further include a plurality of apertures 350 spaced along the length of the arms and configured to receive the ends of hanger rods. In addition, each center arm 315 may include an upper edge 355 that includes spaced curved indents 360 configured to hold hangers. Further defined, each center arm 315 may further include an end hook 365 also configured to hold a hanger or article of clothing. In addition, the lower center hub 322 may further include channels 370 lined along the edge to accommodate the center rods 325 when in center arms are in the collapsed position.

The upper subassembly 400 includes an upper vertical shaft 405, which has a lower end 407 and an upper end 409. The lower end 407 of the upper vertical shaft 405 secures to the upper end 309 of the center vertical shaft 305 via an upper coupling 550 (further defined below). The upper end 409 of the upper vertical shaft 405 is secured to an upper end hub 410.

The upper subassembly 400 includes a plurality of upper arms 415 that are pivotally secured at one end to an upper end hub 410. The upper end hub 410 is secured in position to the upper vertical shaft 405. Each upper arm 415 further has an upper rod 425 that is pivotally secured at one end to a position 427 along the upper arm 415 and the upper rod 425 has another end 429 pivotally secured to a lower upper hub 422 that is slidably received by the upper vertical shaft 405 and which is vertically movable in relation to the upper end hub 410. The upper end hub 410 further includes an tab 430 configured to receive a latch 440 defined on the lower upper hub 422. When the upper arms 415 are expanded outwardly the lower upper hub 422 slides towards the upper end hub 410 and when fully expanded, the latch 440 locks onto the tab 430 locking the upper arms 415 in position. Retracting the latch 440 releases the tab 430, such that the lower upper hub 422 can slide along the upper vertical shaft 405 to collapse the upper arms inwardly. When the center arms 415 are fully expanded the center rods 425 provide support especially when clothes are placed on the expanded upper arms 415. The upper arms 415 are collapsible for storage purposes.

Each of the upper arms 415 further include a plurality of apertures 450 spaced along the length of the arms and configured to receive the ends of hanger rods. In addition, each upper arm 415 may include an upper edge 455 that includes spaced curved indents 460 configured to hold hangers. Further defined, each upper arm 415 includes an end hook 465 also configured to hold a hanger or article of clothing. In addition, the lower upper hub 422 may further include channels 470 lined along the edge to accommodate the upper rods 425 and a portion of the upper arms 415 when in the collapsed position.

Figure 4A:
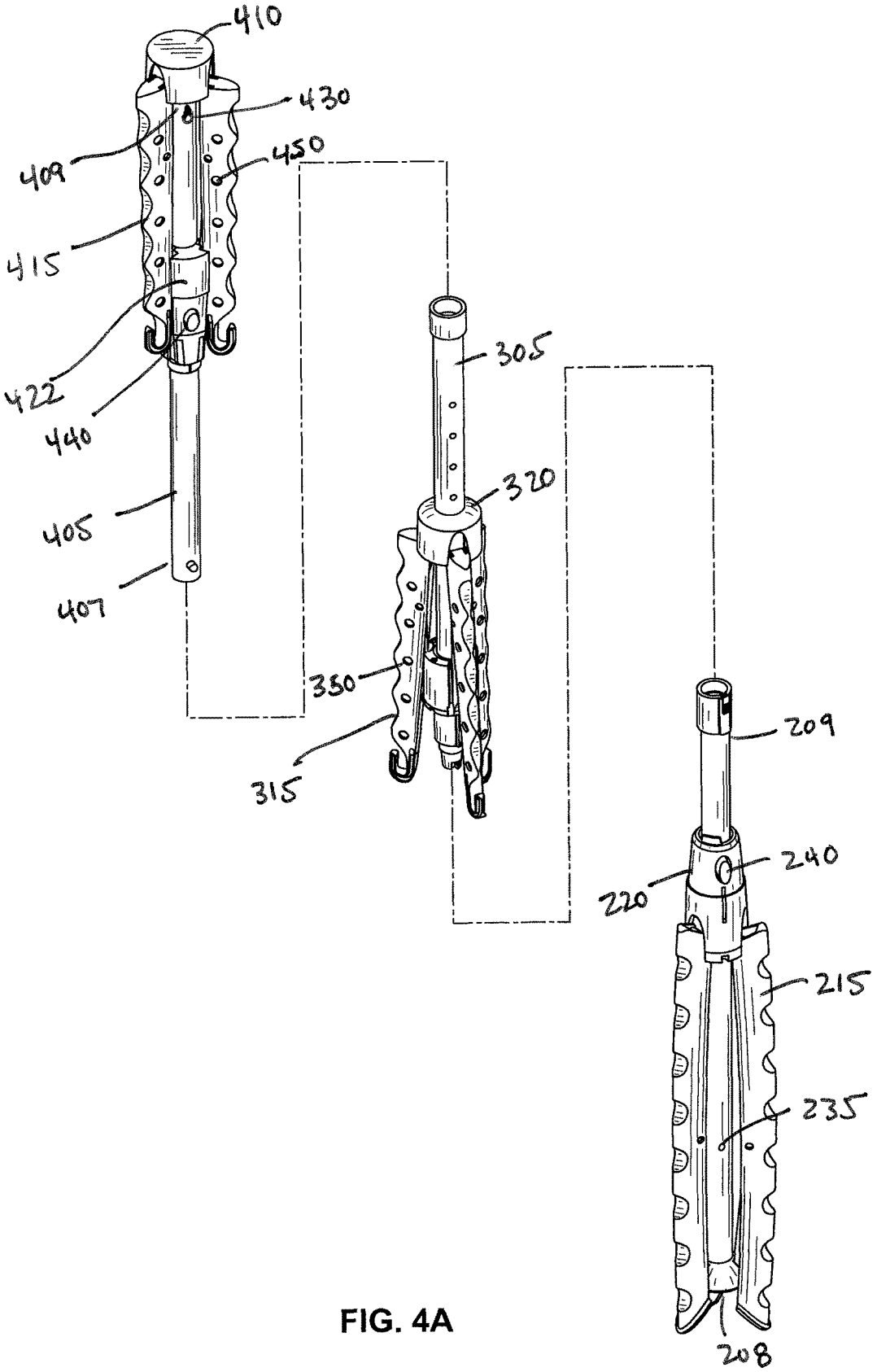
FIG. 4A is a perspective view of the connections used to connect the upper subassembly to the center subassembly and further connect to the lower subassembly.
Figure 4B:
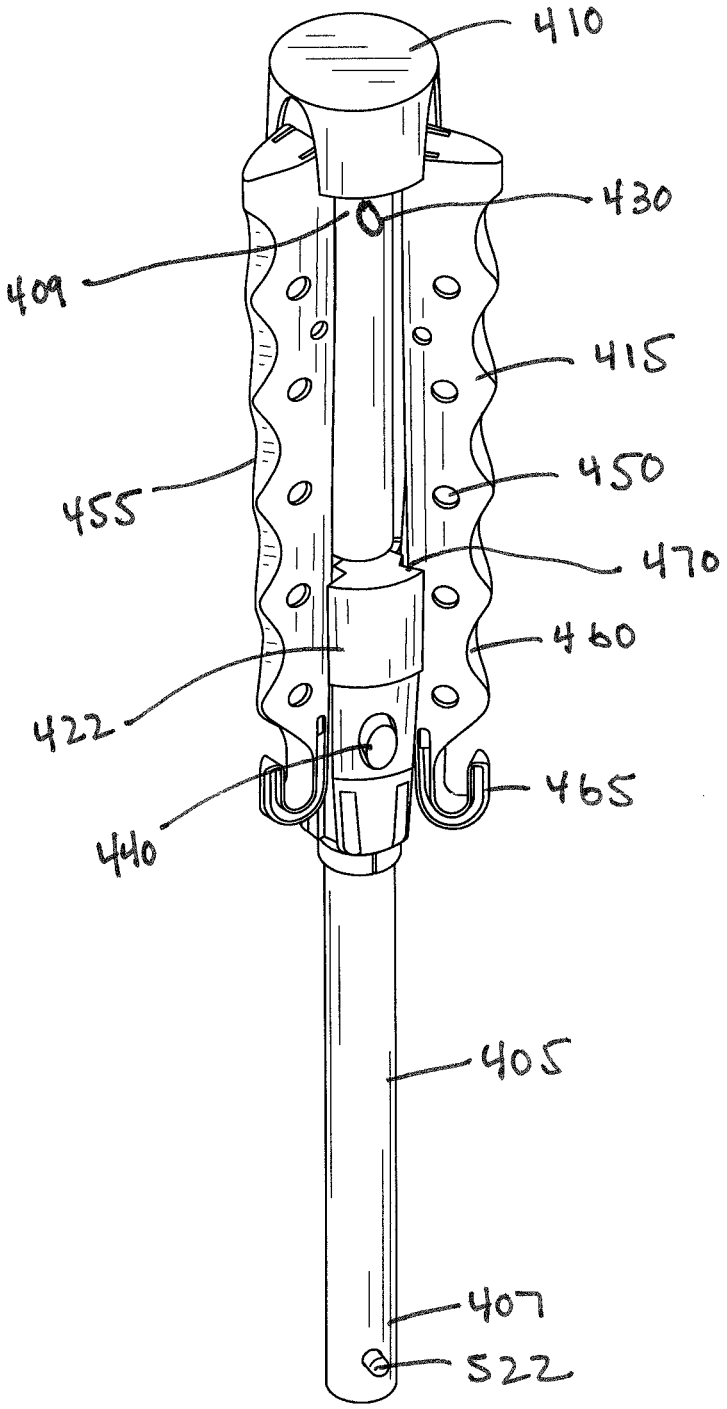
FIG. 4B is an enlarged perspective view of the upper subassembly from FIG. 4A.
Figure 4C:
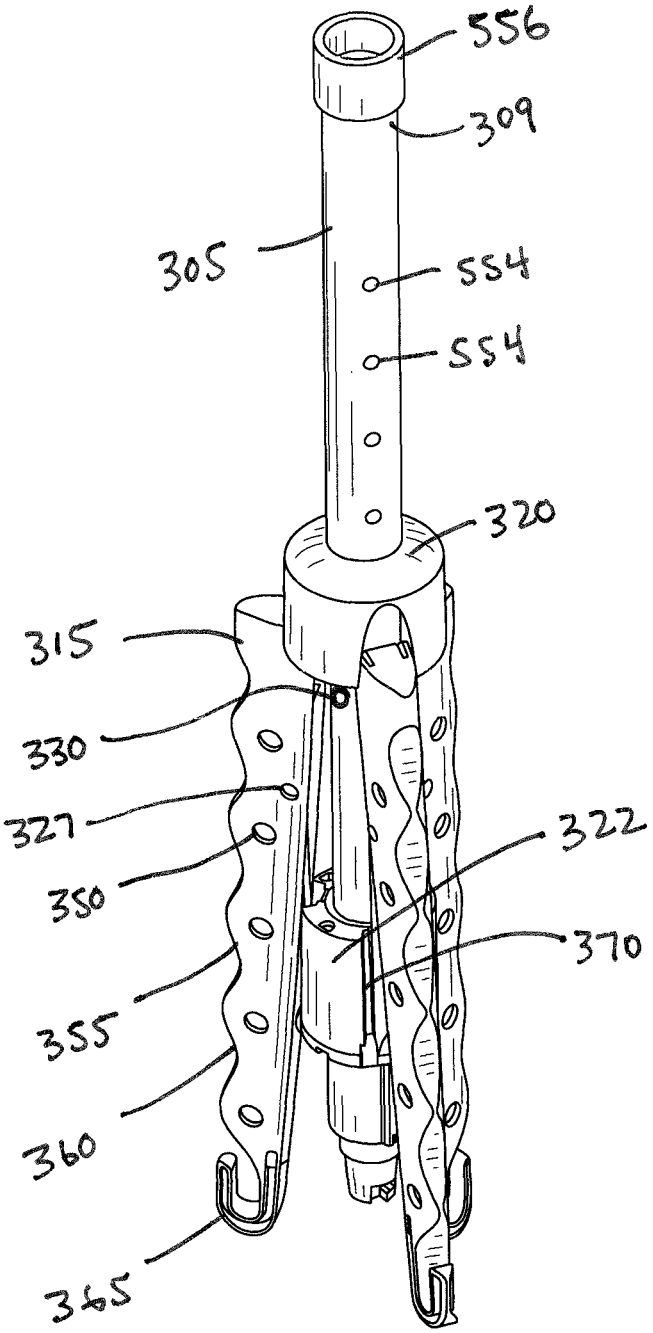
FIG. 4C is an enlarged perspective view of the center subassembly from FIG. 4A.
Figure 4D:
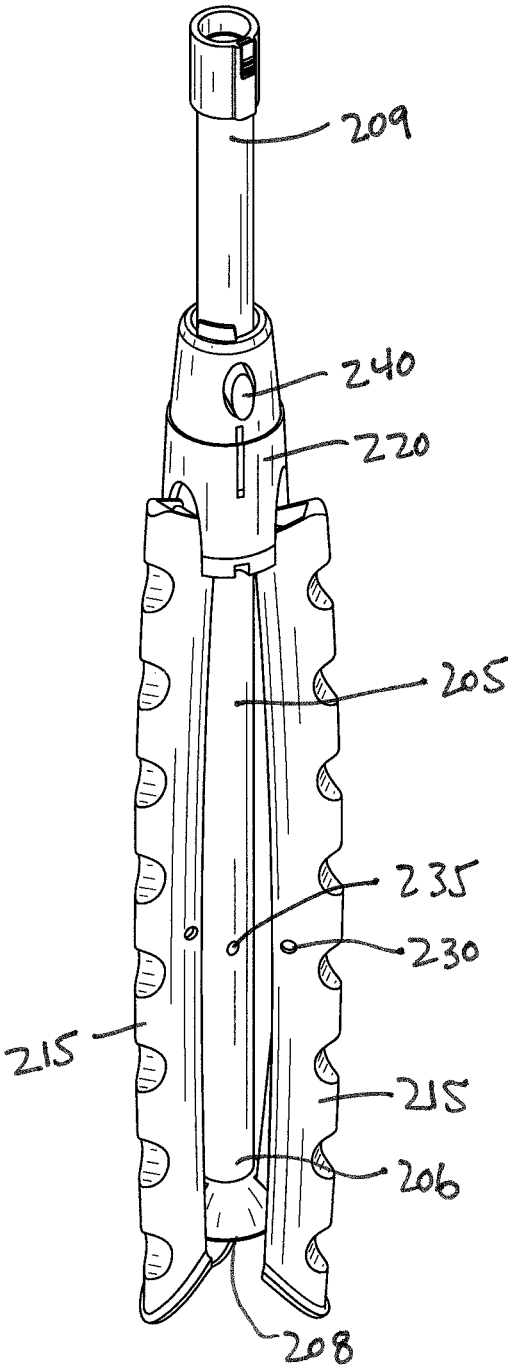
FIG. 4D is an enlarged perspective view of the lower subassembly from FIG. 4A.
Figure 4E:
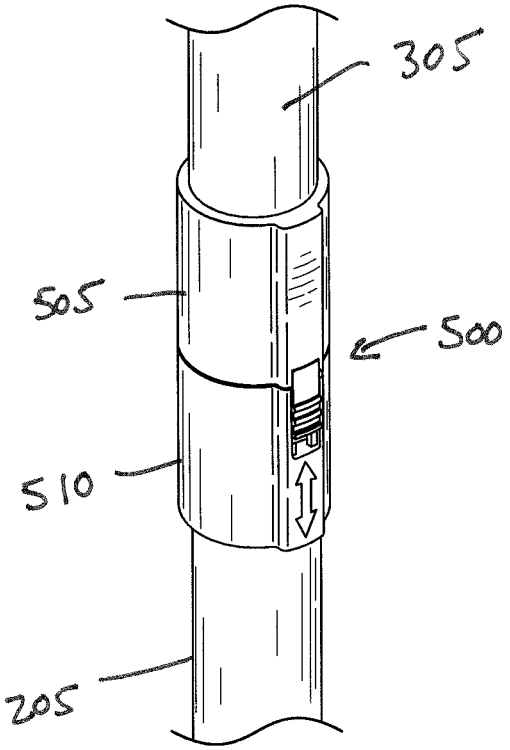
FIGS. 4E and 4F are enlarged perspective views showing the connection between the center and lower subassemblies from FIG. 4A.
Figure 4F:
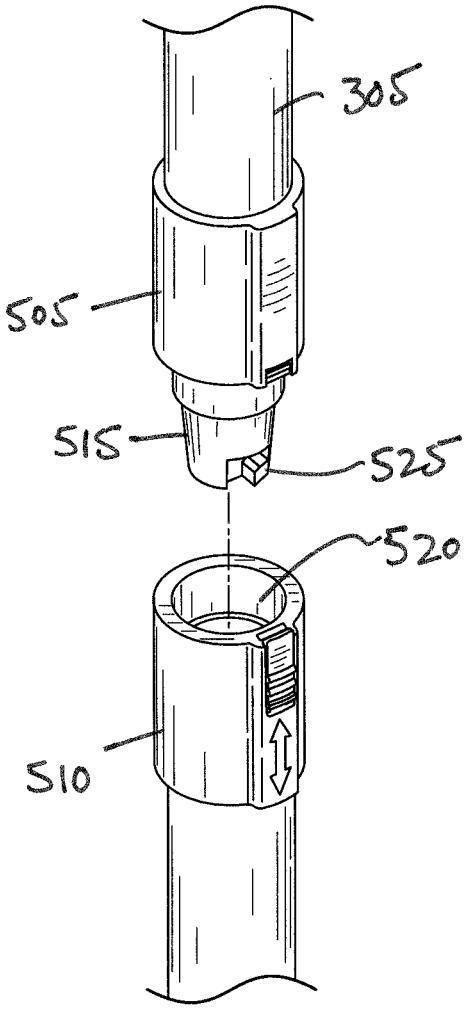
Figure 5:
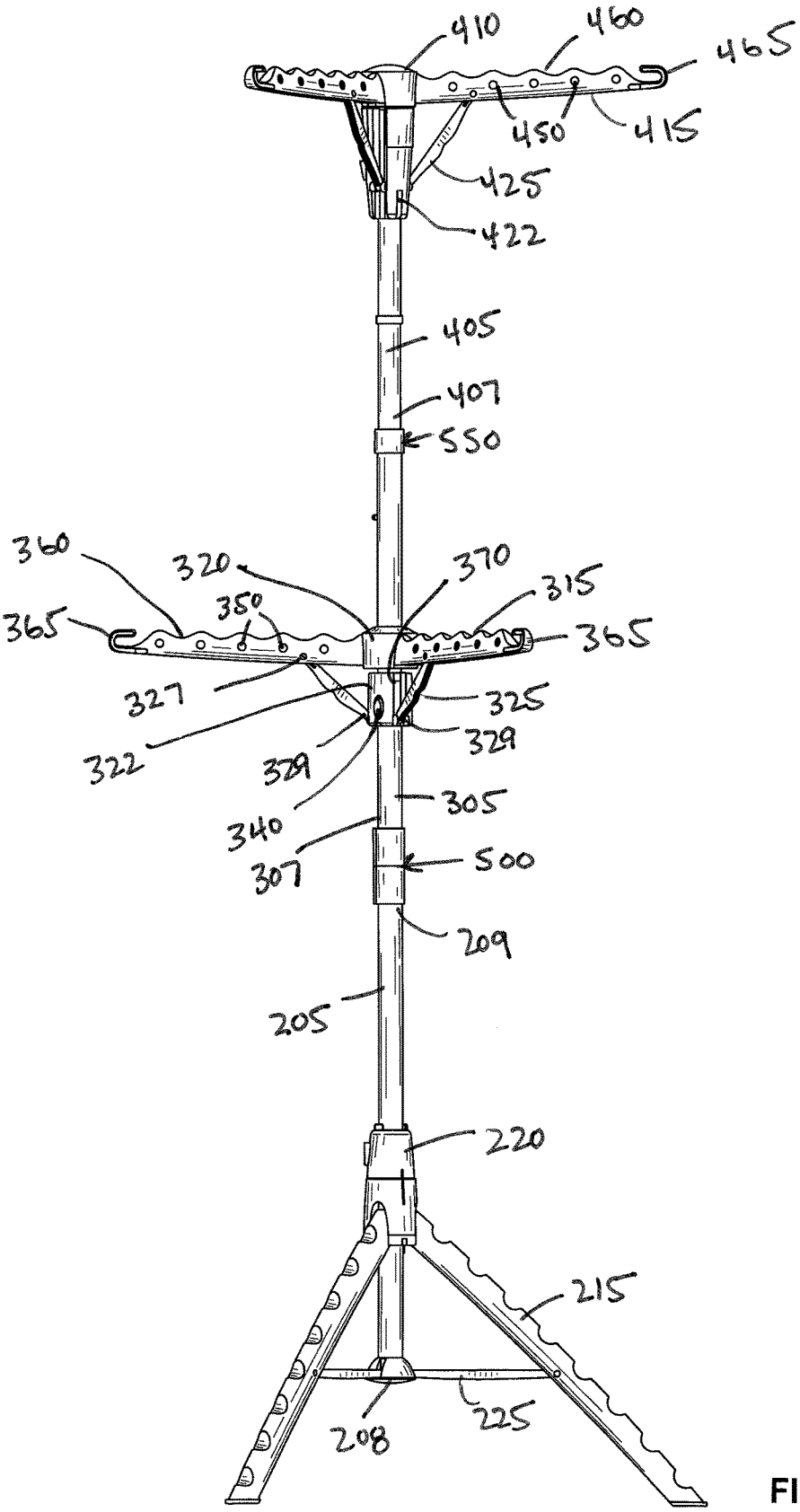
FIG. 5 is a side profile of the clothes rack from FIG. 1.

As further defined by FIGS. 4B and 4C, the upper coupling 550 that secures the upper subassembly 400 to the center subassembly 300 is defined by having a pin 552 (that is biased outwardly) on the lower end 407 of the upper vertical shaft 405 is received by one or more apertures 554 defined on the upper end 309 of the center vertical shaft 305. Having more than one aperture 554 allows the user to adjust the vertical position of the upper subassembly 400. To further accomplish the coupling the upper vertical shaft 405 must include a diameter that is smaller than the diameter of the center vertical shaft 305. It is further defined within the scope of the invention that the upper coupling 550 could be defined by reversing the connection such that the center vertical shaft 305 is smaller than the upper vertical shaft. The center vertical shaft 305 may further include a collar 556 about the upper end thereof to assist in providing additional support to the upper coupling 550.

As further defined by FIGS. 4C through 4F the center coupling 500, the lower end of the center vertical shaft 305 includes a first coupling 505 that mates with a second coupling 510 defined on the upper end of the lower vertical shaft 205. The first coupling 505 includes a member 515 extending downwardly and which is received in an opening 520 on the second coupling 510. The member 515 includes an L shaped channel 525 that mates with a corresponding L shaped flange (not shown) extending internally in the opening 520 of the second coupling 510. When the first coupling 550 is inserted into the opening the mating of the L shaped channel and corresponding flange causes the user to press downwardly and rotate the center vertical shaft in relation to the lower vertical shaft to achieve a strong coupling between the two subassemblies.

While the instant invention has been shown and described in accordance with a preferred and practical embodiment thereof, it is recognized that departures from the Instant disclosure are contemplated within the spirit and scope of the present invention.

What is claimed is:

1. A clothes rack comprising:

a lower subassembly, a center subassembly and an upper subassembly, wherein the lower subassembly is configured to detachably connect to a lower end of the center subassembly and the upper subassembly is configured to detachably connect to an upper end of the center subassembly;

the lower subassembly comprising a lower vertical shaft with a tripod formed by three legs pivotally connected to a hub slidably received by the lower vertical shaft, the tripod configured to provide support on a surface when in an expanded configuration and further configured for storage when in a collapsed configuration;

the center subassembly comprising a center vertical shaft with a lower end and an upper end, the lower end of the center vertical shaft is configured to secure to an upper end of the lower vertical shaft by a center coupling, an upper center hub secured about the center vertical shaft, and a plurality of center arms each having a first end and a second end distal thereto, the first end of each of the plurality of center arms being pivotally secured to the upper center hub, wherein when the second end, of the plurality of center arms, is pivoted outwardly away from the center vertical shaft, the center subassembly is in an expanded configuration and wherein when the second end, of the of the plurality of center arms, is positioned adjacent the center vertical shaft, the center subassembly is in a collapsed configuration;

the upper subassembly comprising an upper vertical shaft having a lower end and an upper end, wherein the lower end of the upper vertical shaft secures to the upper end of the center vertical shaft by an upper coupling, and wherein the upper end of the upper vertical shaft is secured to an upper end hub, and a plurality of upper arms each having a first and second end distal thereto, the first end of each of the plurality of upper arms being pivotally secured to the upper end hub, wherein when the second end, of the plurality of upper arms, is pivoted outwardly away from the upper vertical shaft, the upper subassembly is in an expanded configuration and wherein when the second end, of the of the plurality of upper arms, is positioned adjacent the upper vertical shaft, the upper subassembly is in a collapsed configuration, and wherein one or more of the center arms or upper arms include a plurality of apertures spaced along the length of the one or more arms and each aperture being configured to receive the ends of a hanger rod, and wherein one or more of the center arms or upper arms include an upper edge that includes spaced curved indents further configured to hold hangers, and wherein one or more of the center arms or upper arms include an end hook defined on an end and configured to hold a hanger or article of clothing.

2. The cloths rack of claim 1, wherein the lower subassembly further includes a base cap secured to a lower end defined by the lower vertical shaft and the lower subassembly further includes three rods separately and pivotally secured at one end to the base cap and pivotally secured at another end to a point defined on each of the three legs.

3. The clothes rack of claim 1, wherein the center subassembly further comprising:

a lower center hub slidably received by the center vertical shaft, and a center rod corresponding to each center arm, of the plurality of center arms, each center rod being pivotally secured at one end to a position on the center arm and each center rod being further pivotally secured at another end to the lower center hub, wherein when the center subassembly is in the expanded configuration the center rods extend to provide support to the plurality of center arms.

4. The clothes rack of claim 3, wherein the lower center hub of the center subassembly further includes channels lined along the edge and aligned to accommodate one of the center rods when the center arms are in the collapsed position.

5. The clothes rack of claim 4, wherein the upper center hub further includes a tab configured to receive a latch defined on the lower center hub such that when the center arms are expanded outwardly the lower center hub slides towards the upper center hub and when fully expanded, the latch locks onto the tab locking the center arms in position, and wherein when the latch releases the tab the lower center hub is released to slide along the center vertical shaft.

6. The clothes rack of claim 5, wherein the upper end hub further includes a tab configured to receive a latch defined on the lower upper hub such that when the upper arms are expanded outwardly the lower upper hub slides towards the upper end hub and when fully expanded, the latch locks onto the tab locking the upper arms in position, and wherein when the latch releases the tab the lower upper hub is released to slide along the upper vertical shaft.

7. The clothes rack of claim 1, wherein the upper subassembly further comprising:

a lower upper hub slidably received by the upper vertical shaft, and an upper rod corresponding to each upper arm, of the plurality of upper arms, each upper rod being pivotally secured at one end to a position on the upper arm and each upper rod being further pivotally secured at another end to the lower upper hub, wherein when the upper subassembly is in the expanded configuration the upper rods extend to provide support to the plurality of upper arms.

8. The clothes rack of claim 1, wherein the upper coupling includes a pin on the lower end of the upper vertical shaft, the pin being received by at least two vertically aligned apertures defined on the upper end of the center vertical shaft allowing the upper assembly to adjust vertically into a position.

9. The clothes rack of claim 1, wherein the center coupling includes:

a first coupling defined on the lower end of the center vertical shaft configured to mate with a second coupling defined on the upper end of the lower vertical shaft, and wherein the first coupling includes a member extending downwardly and that is received in an opening on the second coupling, the member further including an L shaped channel that mates with a corresponding L shaped flange extending internally in the opening of the second coupling.

* * * * *